US009920728B2

(12) United States Patent
Reinhardt et al.

(10) Patent No.: US 9,920,728 B2
(45) Date of Patent: Mar. 20, 2018

(54) FUEL INJECTION SYSTEM COMPRISING A FUEL-GUIDING COMPONENT, A FUEL INJECTION VALVE AND A MOUNTING

(71) Applicant: Robert Bosch GmbH, Stuttgart (DE)

(72) Inventors: Wilhelm Reinhardt, Oetisheim (DE); Volker Scheef, Ludwigsburg (DE); Michael Mayer, Wannweil (DE); Andreas Rehwald, Beitigheim-Bissingen (DE); Jan Herrmann, Stuttgart (DE); Philipp Rogler, Stuttgart (DE); Andreas Glaser, Stuttgart (DE); Hans-Georg Horst, Leonberg (DE); Martin Riemer, Untergruppenbach (DE); Michael Knorpp, Weissach (DE); Michael Fischer, Niefern-Oeschelbronn (DE)

(73) Assignee: ROBERT BOSCH GMBH, Stuttgart (DE)

( * ) Notice: Subject to any disclaimer, the term of this patent is extended or adjusted under 35 U.S.C. 154(b) by 156 days.

(21) Appl. No.: 14/762,323

(22) PCT Filed: Jan. 14, 2014

(86) PCT No.: PCT/EP2014/050591
§ 371 (c)(1),
(2) Date: Jul. 21, 2015

(87) PCT Pub. No.: WO2014/114526
PCT Pub. Date: Jul. 31, 2014

(65) Prior Publication Data

US 2016/0003205 A1 Jan. 7, 2016

(30) Foreign Application Priority Data

Jan. 22, 2013 (DE) ..... 10 2013 200 993

(51) Int. Cl.
*F02M 61/14* (2006.01)

(52) U.S. Cl.
CPC ..... *F02M 61/14* (2013.01); *F02M 2200/09* (2013.01); *F02M 2200/16* (2013.01);
(Continued)

(58) Field of Classification Search
CPC ..... F02M 55/004; F02M 55/02; F02M 61/14; F02M 69/465; F02M 2200/858
See application file for complete search history.

(56) References Cited

U.S. PATENT DOCUMENTS 4,295,452 A * 10/1981 Lembke ..... F02M 55/004 123/469
4,844,515 A * 7/1989 Field ..... F02M 55/00 285/305

(Continued)

FOREIGN PATENT DOCUMENTS

AT 4632 U1 9/2001
CN 1481474 A 3/2004

(Continued)

*Primary Examiner* — Joseph Dallo
*Assistant Examiner* — Anthony L Bacon
(74) *Attorney, Agent, or Firm* — Norton Rose Fulbright US LLP; Gerard Messina

(57) ABSTRACT

A mounting is provided for fuel injection systems, the mounting connecting a fuel injection valve to a fuel-conducting component, and having a connecting body and a connecting piece that are connected to one another. Inside the connecting body and the connecting piece there is configured a receptacle space in which a fuel connector of the fuel injection valve is at least partly situated. An inner collar is configured on the connecting piece. In addition, an elastically deformable element is provided. The elastically deformable element is supported at least indirectly on the inner collar of the connecting piece. In addition, the fuel connector is supported at least indirectly on the elastically (Continued)

deformable element. In addition, a fuel injection system having such a mounting is described.

8 Claims, 3 Drawing Sheets

(52) U.S. Cl.
CPC . *F02M 2200/306* (2013.01); *F02M 2200/853* (2013.01); *F02M 2200/855* (2013.01); *F02M 2200/856* (2013.01)

(56) References Cited

U.S. PATENT DOCUMENTS 6,374,806 B1 * 4/2002 Keeley ..... F02M 55/004 123/456
6,415,768 B1 * 7/2002 Usui ..... F02M 55/02 123/468
6,419,282 B1 * 7/2002 Hornby ..... F02M 55/004 277/613
7,334,571 B1 2/2008 Beardmore
2003/0145831 A1 * 8/2003 Liskow ..... F02M 55/004 123/470
2008/0053409 A1 * 3/2008 Beardmore ..... F02M 61/14 123/470
2008/0302336 A1 * 12/2008 Fuerst ..... F02M 55/025 123/470
2010/0059994 A1 * 3/2010 Sperle ..... F02M 55/02 285/332.1
2012/0038142 A1 * 2/2012 Legrand ..... F02M 55/002 285/14

FOREIGN PATENT DOCUMENTS

CN 102245890 A 11/2011
CN 104246205 A 12/2014
DE 10 2005 020380 11/2006
EP 2 058 509 5/2009
EP 2101097 A1 9/2009
JP 2002070687 A 3/2002
JP 2011196260 A 10/2011
WO WO 2013/160068 10/2013

* cited by examiner

FUEL INJECTION SYSTEM COMPRISING A FUEL-GUIDING COMPONENT, A FUEL INJECTION VALVE AND A MOUNTING

FIELD OF THE INVENTION

The present invention relates to a mounting for fuel injection systems for connecting a fuel injection valve to a fuel-conducting component, and to a fuel injection system having such a mounting. Specifically, the present invention relates to the area of fuel injection systems for mixture-compressing externally ignited internal combustion engines.

BACKGROUND INFORMATION

German patent document DE 10 2005 020 380 A1 discusses a fuel injection device having a sound-decoupling design. The fuel injection device includes a fuel injection valve, a receptacle bore for the fuel injection valve in a cylinder head, and a fuel distributor line having a connecting piece. The fuel injection valve is partly inserted into the connecting piece. In a possible embodiment, the fuel injection valve has in the region of its inlet connector a wire ring set in a groove. In addition, a connecting body is provided in the form of a locking nut that is screwed onto an outer threading on the circumference of the connecting piece. On an end facing the connecting piece, the connecting body has a segment that contains an inner threading to which an annular collar is connected that has a curved support surface in the form of a ball socket. With this support surface, the annular collar of the connecting body is supported on the wire ring, which is accommodated in the annular collar with its curvature.

The fuel injection device from DE 10 2005 020 380 A1 is believed to have the disadvantage that vibrations can be transmitted, via the wire ring, between the connecting piece and the inlet connector of the fuel injection valve. Specifically, vibrations can be transmitted from the fuel injection valve to the connecting piece.

Specifically in the case of electromagnetic high-pressure injection valves that are used in gasoline engines having direct injection, a noticeable and disturbing contribution to the overall noise level of the engine can be made, which can be described as valve ticking. Such valve ticking arises due to the rapid opening and closing of the fuel injection valve, in which the valve needle is moved to its respective end stop positions with a high dynamic characteristic. The impacting of the valve needle at the end stop positions causes brief but very strong contact forces that are transmitted via a housing of the fuel injection valve to the cylinder head and to a fuel distributor rail, in the form of structure-borne sound and vibrations. This causes a strong development of noise at the cylinder head and at the fuel distributor rail.

SUMMARY OF THE INVENTION

The mounting according to the present invention having the features described herein and the fuel injection system according to the present invention having the features described herein have the advantage that an improved mounting of the fuel injection valve on the fuel-conducting component is enabled. Here, a reduction of noise is possible through a targeted decoupling. Specifically, a soft connection of the fuel injection valve to the fuel-conducting component can be achieved, enabling a reduction of noise in the overall system having the fuel injection system.

Through the features described in the description herein, advantageous developments of the mounting described herein, and of the fuel injection system described herein, are possible.

Specifically, the mounting and the fuel injection system are suitable for direct injection of gasoline. Here, the fuel-conducting component may be configured as a fuel distributor, in particular as a fuel distributor rail. Such a fuel distributor can on the one hand be used to distribute the fuel to a plurality of fuel injection valves, in particular high-pressure injection valves. On the other hand, the fuel distributor can be used as a common fuel storage unit for the fuel injection valves. The fuel injection valves may then be connected to the fuel distributor via corresponding mountings. During operation, the fuel injection valves then inject the fuel necessary for the combustion process into the respective combustion chamber under high pressure. Here, the fuel is compressed by a high-pressure pump, and is conveyed, with control of quantity, into the fuel distributor via a high-pressure line.

The fuel injection valve, in particular the fuel connector, is not a component of the mounting according to the present invention. In particular, the mounting according to the present invention can also be produced and distributed separately from the fuel injection valve. The connecting body can be a part of a fuel-conducting component. In particular, the connecting body can be configured as part of a cup of a fuel distributor rail. Here, the connecting body can however also be connected at a later time to a tube-shaped basic body or the like of the fuel distributor rail, for example by welding. In this way, the mounting according to the present invention is not necessarily a component of the overall fuel-conducting component, and can also be manufactured and distributed independently of such further components of a fuel-conducting component.

In particular, a soft connection of the fuel injection valve to the fuel-conducting component, in particular a fuel distributor, can be achieved. A soft realization of this interface enables a significant reduction of noise in the overall system having the fuel injection system. The soft connection of the fuel injection valve to the fuel-conducting component can here take place with a target rigidity of not more than 50 kN/mm, and here the strength requirements can be maintained over the lifespan of the equipment. The advantage of the soft mounting is a significant reduction in the transmitted structure-borne sound from the fuel injection valve to the fuel-conducting component and, connected therewith, a reduction in the noise level of the injection system. Moreover, this noise-reducing measure can be used in addition to further noise-reducing measures, such as a hydraulic throttle at the valve inlet and a soft screwed connection at the rail. In addition, the mounting can advantageously be used without, or with only slight, constructive modifications to existing constructions. This results in a broader range of possible use.

It is advantageous that on the inner collar of the connecting piece there is configured a seating surface that is made conical relative to a longitudinal axis of the receptacle space and that faces the receptacle space. The conical seating surface, which can have an opening angle in a range of from approximately 10° to approximately 80°, in particular at least approximately 45°, in particular relative to the longitudinal axis, ensures an advantageous centering. Moreover, given a suitable realization of the angle of the conical seating surface, an angular tolerance compensation can be ensured for the fuel injection valve relative to the longitudinal axis of the receptacle space. Here, the angular tolerance compensation can also be realized through an elastic deformation of the elastically deformable element. Via the conical seating surface, there takes place, at least indirectly, an orientation of the elastically deformable element relative to the longitudinal axis of the receptacle space, and thus there takes place the orientation of the fuel connector of the fuel injection valve.

It is also advantageous that an annular supporting element is provided, and that the elastically deformable element is supported on the inner collar of the connecting piece by the annular supporting element. This is particularly advantageous because the conical seating surface is also provided on the inner collar of the connecting piece. In this way, an orientation of the annular supporting element relative to the longitudinal axis of the receptacle space is achieved. Here, the annular supporting element may have a rounded outer contour relative to the seating surface of the inner collar. This ensures a tolerance compensation at the interface between the annular supporting element and the inner collar, such that a self-centering takes place during operation.

Here it is also advantageous that the annular supporting element has an annular opening into which the elastically deformable element is at least partly placed. The placement of the elastically deformable element into the annular opening of the annular supporting element ensures on the one hand a mechanical protection, in particular preventing local overstressing. In addition, a uniform introduction of force, and thus homogenous loading of the elastically deformable element, is ensured. In addition, the elastically deformable element is in this way reliably positioned. Crushing of the elastically deformable element due to wrong positioning, incorrect installation, clamping at some points, buckling, or the like are in this way prevented from the outset.

Here it is particularly advantageous that the annular opening of the annular supporting element is made so as to be inwardly open. In this way, on the one hand an elastic deformability of the elastically deformable element is enabled also in the radial direction, because radial support on the annular supporting element is ensured. On the other hand, in this way a direct contact can be avoided between the annular supporting element and an outer side of the fuel connector. However, a deformation of the elastically deformable element can nonetheless be limited.

Moreover, it is advantageous that on the fuel connector, or on an element connected to the fuel connector, there is configured a supporting surface, and that an annular angled element is provided that has an L-shaped profile into which the elastically deformable element is at least partly placed, and that the fuel connector is supported on the elastically deformable element at least by the annular angled element. The annular angled element also enables a mechanical protection of the elastically deformable element. In particular, a homogenous introduction of force into the elastically deformable element is enabled. Moreover, a local overstressing of the elastically deformable element is prevented from the outset. Wear due to friction or the like, which in principle is possible on an outer side of the elastically deformable element due to rubbing or shearing, is also prevented in this way.

Here it is also advantageous that the annular angled element is seated on an outer side of the fuel connector. In this way, a reliable fixing of the annular angled element on the fuel connector is enabled, so that vibrations are transmitted directly to the elastically deformable element. Contact noises between the annular angled element and the fuel connector are in this way prevented from the outset.

It is also advantageous that the element connected to the fuel connector is connected to the fuel connector with a material fit. For example, the element connected to the fuel connector can be configured as a disk-shaped element that is welded to the fuel connector.

It is also advantageous that a U-shaped connecting clip is provided, and that the connecting piece is connected to the connecting body via the U-shaped connecting clip, and that the connecting body has on its outer side at least one opening, and that the connecting piece has on its inner side at least one opening that is allocated to the opening of the connecting body, and that the U-shaped connecting clip engages internally in the at least one opening of the connecting body and externally in the at least one opening of the connecting piece, and that the U-shaped connecting clip is oriented at least approximately perpendicular to a longitudinal axis of the receptacle space. In this way, a simple installation is enabled. During this installation, the pot-shaped connecting piece can be attached on the fuel connecting piece. Then the elastically deformable element, inter alia, can be mounted. Subsequently, for example the disk-shaped element can be connected to the fuel connector by welding. After this pre-assembly, the fuel connector can be positioned, together with the connecting piece, on the fuel-conducting component. Here, the connecting piece is suitably positioned on the connecting body so that the U-shaped connecting clip can be inserted into the opening of the connecting body and into the opening of the connecting piece. In addition, here simple disassembly is also enabled, which may be required for example during servicing.

In a modified embodiment, the connecting piece can also be realized in the form of a cap nut. In this way, a detachable connection can also be achieved between the fuel injection valve and the fuel-conducting component.

Exemplary embodiments of the present invention are explained in more detail in the following description with reference to the accompanying drawings, in which corresponding elements are provided with the same reference characters.

DETAILED DESCRIPTION

Figure 1:
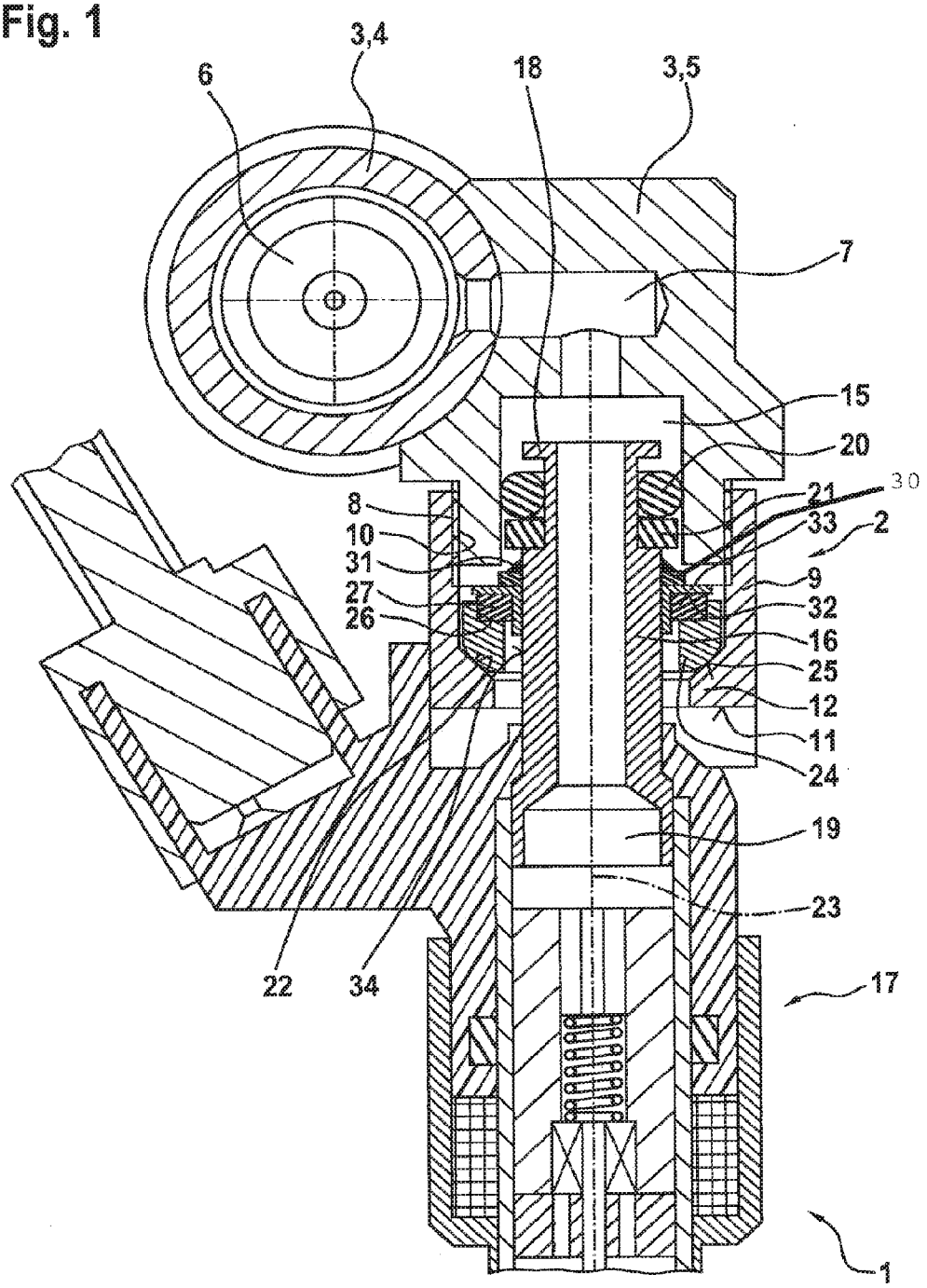
FIG. 1 shows a fuel injection system having a mounting, in a partial schematic sectional representation corresponding to a first exemplary embodiment of the present invention.

FIG. 1 shows a fuel injection system 1 having a mounting 2, in a partial schematic sectional representation corresponding to a first exemplary embodiment. Fuel injection system 1 can be used in particular for high-pressure injection in internal combustion engines. Specifically, fuel injection system 1 can be used in mixture-compressing externally ignited internal combustion engines. Mounting 2 is particularly suitable for such a fuel injection system 1.

Fuel injection system 1 has a fuel-conducting component 3 that, in this exemplary embodiment, is configured as fuel distributor rail 3. Fuel distributor rail 3 has a tube-shaped main body 4 and a connecting body 5. In tube-shaped main body 4 there is configured an oblong combustion chamber 6, from which there branches off a connecting duct 7 that is routed through connecting body 5. Here, further connecting bodies, which are configured in a manner corresponding to connecting body 5, may be attached on tube-shaped main body 4. Here, connecting body 5 is a component of mounting 2. Connecting body 5 can be connected to tube-shaped main body 4 in a suitable manner. However, tube-shaped main body 4 is not necessarily a component of mounting 2, because mounting 2 having connecting body 5 can also be manufactured and distributed independently of tube-shaped main body 4. In the context of a pre-installation, connecting body 5 can then be connected, together with further correspondingly configured connecting bodies, to tube-shaped main body 4, which is possible for example by welding. In this exemplary embodiment, connecting body 5 has an outer threading 8. In addition, mounting 2 has a connecting piece 9 having an inner threading 10. At least in the region of inner threading 10, connecting piece 9 is configured with a tubular shape. Here, connecting piece 9 has at an end face 11 an interior collar 12. In the assembled state, as shown in FIG. 1, connecting piece 9 is screwed with its inner threading 10 onto an outer threading 8 of connecting body 5. In this exemplary embodiment, connecting piece 9 is thus configured in the form of a cap nut 9. In this exemplary embodiment, connecting body 5 is configured as rail cup 5.

In this way, connecting body 5 and connecting piece 9 are connected to one another. In the connected state, a receptacle space 15 is configured inside connecting body 5 and connecting piece 9, in which a fuel connector 16 of a fuel injection valve 17 of fuel injection system 1 is partly situated.

Fuel connector 16 has a collar 18 on which there is provided an inlet for the fuel, in order to conduct the fuel from connecting duct 7 into a fuel chamber 19 in the interior of fuel injection valve 17. In the area of collar 18, a sealing ring 20 is provided that is situated between fuel connector 16 and connecting body 5 in order to form a seal. Sealing ring 20 is here situated between collar 18 and a support ring 21. Support ring 21 surrounds a tapered segment of fuel connector 16.

On inner collar 12 of connecting piece 9 there is configured a seating surface 22. Seating surface 22 is here oriented toward receptacle space 15. In addition, seating surface 22 is made with a conical shape relative to a longitudinal axis 23 of receptacle space 15. An opening angle for seating surface 22 can for example be approximately 45°.

Moreover, an annular support element 24 is provided on which there is configured a rounded edge 25. Annular support element 24 is situated in receptacle space 15, and surrounds fuel connector 16. Rounded edge 25 of annular support element 24 here faces support surface 22 of inner collar 18. Annular support element 24 is supported on seating surface 22 of inner collar 18 via rounded edge 25.

In addition, annular support element 24 has an annular opening 26. Annular opening 26 is made inwardly open. This means that annular opening 26 is made so as to be open toward fuel connector 16. An elastically deformable element 27 is partly placed into annular opening 26.

Elastically deformable element 27, which is placed partly into annular opening 26 of annular support element 24, is thus supported on inner collar 18 of connecting piece 9 via annular supporting element 24. In this way, in this exemplary embodiment elastically deformable element 27 is indirectly supported on inner collar 18. In a modified embodiment, elastically deformable element 27 can however also be supported directly on inner collar 12 of connecting piece 9.

In addition, in this exemplary embodiment an annular element 30 is provided that is connected to fuel connector 16 via a weld seam 31. In a modified embodiment, annular element 30 can however also be configured as snap ring 30, or can be connected to fuel connector 16 in some other way.

A support surface 32 is configured on annular element 30. In a modified embodiment, however, support surface 32 can also be configured directly on fuel connector 16, in particular on a collar of fuel connector 16.

In addition, an annular angled element 33 is provided that has an L-shaped profile into which elastically deformable element 27 is partly placed. Elastically deformable element 27 has, in this exemplary embodiment, a rectangular, in particular quadratic, profile, and is made with an annular shape. Thus, elastically deformable element 27 is situated between annular angled element 33 and angular support element 24.

Thus, in this exemplary embodiment elastically deformable element 27 is supported on support surface 32 of annular element 30 by annular angled element 33. Thus, elastically deformable element 27 is supported indirectly on support surface 32 of annular element 30. In a modified embodiment, elastically deformable element 27 can also be supported directly on support surface 32 of annular element 30.

In this exemplary embodiment, annular angled element 33 is supported on an outer side 34 of fuel connector 16. In this way, a stationary positioning of annular angled element 33 on fuel connector 16 is ensured.

Via a weld seam 31, in this exemplary embodiment a material connection of annular element 30 to fuel connector 16 is formed. However, a positive connection can also be provided. Other types of connection are also conceivable.

Thus, fuel connector 16 is supported on inner collar 18 of connecting piece 9 at least via elastically deformable element 27. In this way, a direct contact between connecting piece 9 and fuel connector 16 is avoided. In this way, vibrations are substantially damped. Therefore, an elastic bearing of fuel injection valve 17 can advantageously be realized. Here, elastically deformable element 27 can be realized by a wire mesh, a plate spring, a special spring, or in some other way. Here, elastically deformable element 27 can be configured in such a way that it also acts as angular tolerance compensating element 27. The flow of force between fuel connector 16 and fuel-conducting component 3 is guided via elastically deformable element 27, and in this way a transmission of vibrations is substantially damped.

Figure 2:
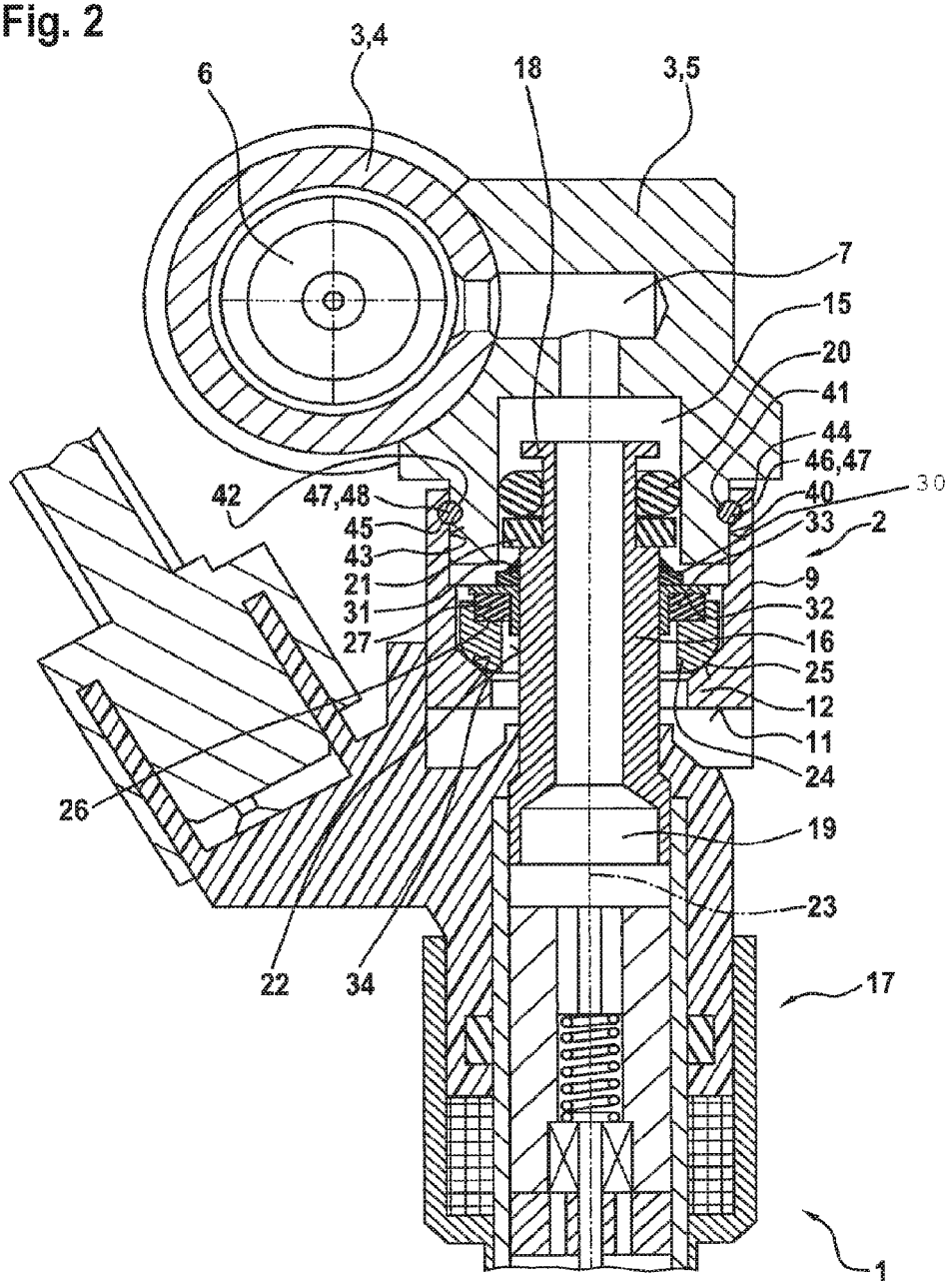
FIG. 2 shows a fuel injection system having a mounting, in a partial schematic sectional representation corresponding to a second exemplary embodiment of the present invention.

FIG. 2 shows a fuel injection system 1 having a mounting 2 in a partial schematic sectional representation corresponding to a second exemplary embodiment. In this exemplary embodiment, connecting body 5 has openings 41, 42 on its outer side 40. In addition, connecting piece 9 has openings 44, 45 on its inner side 43. Opening 44 of connecting piece 9 is here allocated to opening 41 of connecting body 5. In addition, opening 45 of connecting piece 9 is allocated to opening 42 of connecting body 5. In the installed state, opening 41 of connecting body 5 and opening 44 of connecting piece 9 form a cylindrical open space into which an arm 46 of a U-shaped connecting clip 47 is inserted. In addition, opening 45 of connecting piece 9 and opening 42 of connecting body 5 form a cylindrical open space into which a further arm 48 of U-shaped connecting clip 47 is inserted. U-shaped connecting clip 47 is here oriented perpendicular to longitudinal axis 23 of receptacle space 15. This means that the two arms 46, 48 are situated in a plane that is oriented perpendicular to longitudinal axis 23.

Thus, connecting piece 9 is connected to connecting body 5 via a U-shaped connecting clip 47. In this exemplary embodiment, connecting piece 9 is configured as pot-shaped connecting piece 9.

Figure 3:
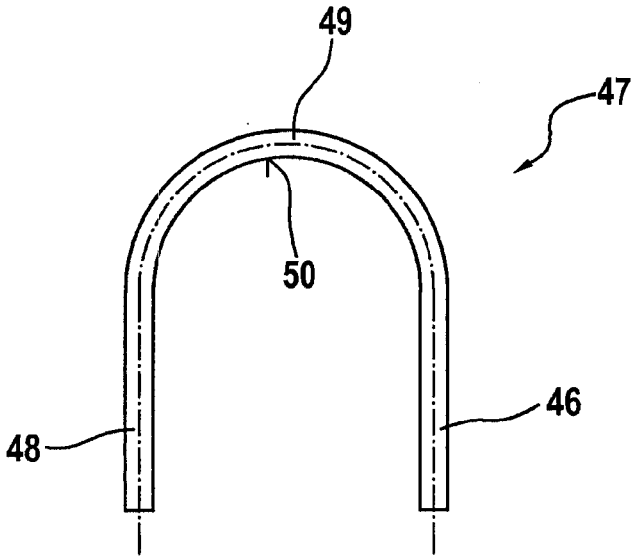
FIG. 3 shows a connecting clip of the mounting shown in FIG. 2, corresponding to the second exemplary embodiment of the present invention.

FIG. 3 shows U-shaped connecting clip 47, shown in FIG. 2 in a schematic representation. Here, arm 46 is connected to further arm 48 via a bent connecting segment 49. An inner side 50 of bent connecting segment 49 can here form a stop for the installation.

The present invention is not limited to the described exemplary embodiments.

What is claimed is:

1. A mounting for a fuel injection system for connecting a fuel injection valve to a fuel-conducting component, comprising:

a connecting piece, there being provided inside the connecting piece a receptacle space in which a fuel connector of the fuel injection valve is at least partly situated, and an inner collar is configured on the connecting piece, wherein an elastically deformable element is provided, and the elastically deformable element is supported at least indirectly on the inner collar of the connecting piece, and the fuel connector is supported at least indirectly on the elastically deformable element;

wherein an annular supporting element is provided, and the elastically deformable element is supported on the inner collar of the connecting piece by the annular supporting element.

2. The mounting of claim 1, wherein the annular support element has an annular opening in which the elastically deformable element is at least partly set, and/or the elastically deformable element is configured as an annular elastically deformable element.

3. The mounting of claim 2, wherein the annular opening of the annular support element is made inwardly open.

4. A mounting for a fuel injection system for connecting a fuel injection valve to a fuel-conducting component, comprising:

a connecting piece, there being provided inside the connecting piece a receptacle space in which a fuel connector of the fuel injection valve is at least partly situated, and an inner collar is configured on the connecting piece, wherein an elastically deformable element is provided, and the elastically deformable element is supported at least indirectly on the inner collar of the connecting piece, and the fuel connector is supported at least indirectly on the elastically deformable element;

wherein a support surface is configured on the fuel connector or on an element connected to the fuel connector, and an annular angled element is provided that has an L-shaped profile in which the elastically deformable element is at least partly set, and the fuel connector is supported on the elastically deformable element at least via the annular angled element.

5. The mounting of claim 4, wherein the annular angled element lies against an outer side of the fuel connector.

6. The mounting of claim 4, wherein the element connected to the fuel connector is connected to the fuel connector with a material fit.

7. A mounting for a fuel injection system for connecting a fuel injection valve to a fuel-conducting component, comprising:

a connecting piece, there being provided inside the connecting piece a receptacle space in which a fuel connector of the fuel injection valve is at least partly situated, and an inner collar is configured on the connecting piece, wherein an elastically deformable element is provided, and the elastically deformable element is supported at least indirectly on the inner collar of the connecting piece, and the fuel connector is supported at least indirectly on the elastically deformable element;

wherein a U-shaped connecting clip is provided, and the connecting piece is connected to a connecting body of the fuel-conducting component via the U-shaped connecting clip, and the connecting body has on its outer side at least one opening, and the connecting piece has on its inner side at least one opening that is allocated to the opening of the connecting body, and the U-shaped connecting clip engages in the at least one opening of the connecting body and in the at least one opening of the connecting piece, and the U-shaped connecting clip is oriented at least approximately perpendicular to a longitudinal axis of the receptacle space.

8. A fuel injection system for mixture-compressing externally ignited internal combustion engines, comprising:

at least one fuel-conducting component;

at least one fuel injection valve; and at least one mounting;

wherein the fuel injection valve is mounted on the fuel-conducting component via the mounting, wherein the mounting includes a connecting piece, there being provided inside the connecting piece a receptacle space in which a fuel connector of the fuel injection valve is at least partly situated, and an inner collar is configured on the connecting piece, wherein an elastically deformable element is provided, and the elastically deformable element is supported at least indirectly on the inner collar of the connecting piece, and the fuel connector is supported at least indirectly on the elastically deformable element, and wherein an annular supporting element is provided, and the elastically deformable element is supported on the inner collar of the connecting piece by the annular supporting element.

* * * * *